United States Patent [19]

Scherer

[11] 4,222,428

[45] Sep. 16, 1980

[54] FOLDING PARTITION

[76] Inventor: Anton Scherer, Sengenthalstrasse 472, Gretzenbach, Schweiz, Switzerland

[21] Appl. No.: 880,165

[22] Filed: Feb. 22, 1978

[30] Foreign Application Priority Data

Mar. 8, 1977 [SE] Sweden ..... 772903

[51] Int. Cl.[2] ..... E06B 3/12; E06B 9/00

[52] U.S. Cl. ..... 160/231 R

[58] Field of Search ..... 160/183, 199, 206, 231 A

[56] References Cited

U.S. PATENT DOCUMENTS

| | | | |
|---|---|---|---|
| 3,131,753 | 5/1964 | Dixon | 160/199 |
| 3,361,189 | 1/1968 | Dixon et al. | 160/231 A |
| 3,403,720 | 10/1968 | Ahleen | 160/231 A |

FOREIGN PATENT DOCUMENTS

| | | | |
|---|---|---|---|
| 2308773 | 11/1976 | France | 160/231 A |

*Primary Examiner*—Peter M. Caun

*Attorney, Agent, or Firm*—Roylance, Abrams, Berdo & Farley

[57] ABSTRACT

The disclosed partition is made up of a plurality of sections interconnected by fabric hinges and hung from a ceiling on rollers guided in a rail, to permit pushing together the sections in accordian manner. The hinges are formed by a fabric strip which has ribs at the longitudinal edges. These ribs are held in a matching recess in the bottom of a groove in the side face of the sections. Also disclosed is a fastener which is anchored in a straight groove in the side face of the sections and is provided with the recess and groove for holding the hinge.

1 Claim, 3 Drawing Figures

1
2
3
4
5
6
7
11
15
16

2
3
4
5
6
7
11
14
15
16

8
9
10
12
13
17

FOLDING PARTITION

BACKGROUND OF THE INVENTION

The present invention relates to a folding partition with partition sections joined to each other by a fabric hinge and which are to be at least partly carried on rollers along a rail fastened a ceiling.

It is known to partition off as desired either rooms themselves or rooms which provide the only access to another room by means of a folding partition, while permitting the partition to be pushed together in the most compact arrangement when not in use.

There are known two types of folding partitions and folding doors: They are the double wall type on the one hand and the single wall type on the other.

The present invention relates to the second-mentioned type, that is, a single wall folding partition or door. As compared to the double wall type, this type requires considerably less material, but also is less effective in the damping of sound.

Since the folding partition or door includes individual partition sections which must be interconnected so that a pushing together of the partition sections may be accomplished without difficulty, certain requirements are set for the interconnecting hinges of the partition sections. On the one hand, the hinges should provide a strong connection which preferably seals entirely the space between the sections. On the other hand, the space between the sections should preferably be indistinguishable from the sections.

There is known a single wall folding partition or door in which the individual sections are interconnected by helical springs which are perpendicular to the hinged side faces of the sections. Such springs are so spaced from the first to the last section that they hold together the individual sections and at the same time permit provide sufficient elasticity to permit pushing the sections together with little effort. The space which in the meantime appears between the sections is covered by molding strips which are fastened to the mentioned springs. While thereby the space is covered, there is no complete sealing of the space.

There is known a suitable sealing with a double wall type partition, in which the sections are interconnected on the inside by a fabric hinge. This arrangement permits keeping the space between the sections relatively small, so that they are hardly noticeable on the outer side. This arrangement cannot be used for a single wall type, since otherwise the fabric hinge would be visible on the side of the partition corresponding to the inner side of the double wall type. Thus, such a single wall arrangement would avoid uncovered hinges, but would have the disadvantage of not providing complete sealing.

It is an object of the present invention to provide a folding partition designed so that there may be used the strong and reliable fabric hinge without it being visible, and so that it is made possible to readily fasten and replace the fabric hinge.

SUMMARY OF THE INVENTION

The novel partition in accordance with the present invention includes a fabric hinge formed by a band which is provided along its edges with a rib and which is held in a correspondingly widened inner cross sectional recessed portion of a groove running longitudinally along the hinged side faces of the sections.

DESCRIPTION OF THE PREFERRED EMBODIMENT

Figure 1:
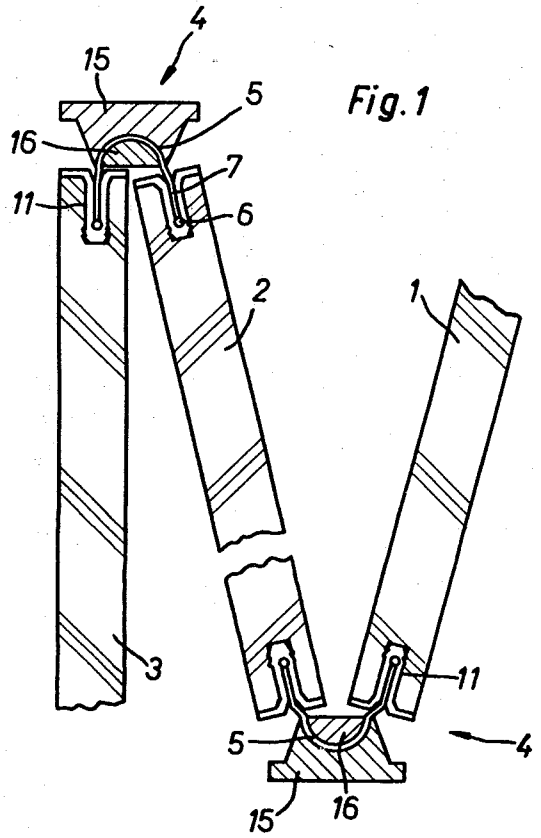
FIG. 1 is a horizontal section through a fragment of a partially pushed together single wall type of folding partition shown in schematic form and in accordance with a preferred embodiment of the present invention.
Figure 2:
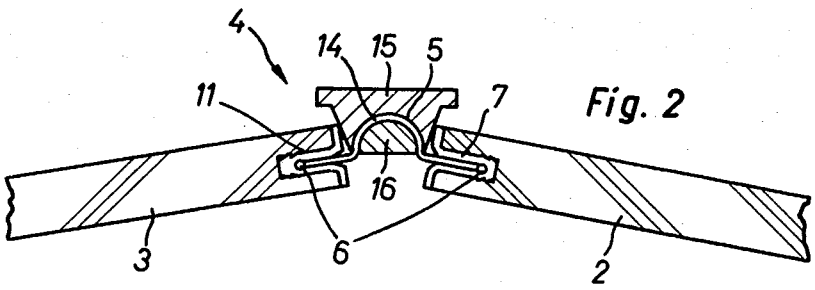
FIG. 2 is a horizontal section through a fragment of the partition of FIG. 1 in a folded condition.

There are shown in the FIGS. 1 and 2 a plurality of partition sections 1, 2, 3 which are interconnected with one another by connecting hinges 4 in such a way that they may be easily pushed together, as in FIG. 1, or extended, as in FIG. 2. The partition sections 1,2,3 may be sections of a folding partition or of a folding door. In the interest of simplicity, the present embodiment will be referred to as a folding partition.

Figure 3:
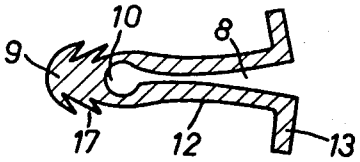
FIG. 3 is a cross-section of a fastener for fastening the hinge to the sections.

The hinged connection 4 is a fabric hinge. That is, that portion which functions as a hinge is a fabric band 5 which is woven for such a purpose. It is essential that the band 5 has a thickened portion in the form of a rib 6 running along each of its longitudinal edges. The edge portion 7 of the band 5 is held in a groove 8 of a fastener 9 (FIG. 3), for which purpose the bottom of the groove 8 has a recess 10 for receiving the rib 6 of the band 5. The recess 10 is wider than the rib 5 when the fastener 9 is held installed in a groove 11 in the hinged side faces of the sections 1,2,3. FIG. 3 shows the fastener 9 in relaxed condition, that being before it has been pressed or hammered into the receiving groove 11.

The fastener 9 has holding arms 12 which angle outwards into covering lips 13 which form a covering for the side faces of the sections 1,2,3.

In its middle portion 14, the fabric band 5 forms an arch which arises because the middle portion 14 is connected to or glued between two profiling strips 15,16 having matching concave and convex profiling parts, respectively. The profiling strips 15,16 cover partically the entire middle portion of the band 5 and are suitably made of the same material, for example wood, as are the sections 1,2,3. Only between the profiling strips 16 and the side surfaces of the middle portions is there visible a short piece of the band 5 which at this point forms a fabric hinge. By means of the stiffening of the middle portion 14 with the profiling strips 15,16 there are formed two fabric hinges which lie immediately adjacent the hinged side faces of the sections and expand only slightly.

In FIGS. 1 and 2 the middle portion 14 of the fabric band 5 has an arcuate form. The middle portion 14 could, however, also have other shapes, such as angular ones.

The use of the fastener 9 together with the fabric band 5 contributes considerably to ease of installation. First the profiling strips 15,16 can be glued together with the fabric band. Then the edge portions 7 of the band 5 are pulled into the fastener 9 and the latter finally tapped into the receiving grooves 11 and at the same time glued. Anchoring of the fastener 9 in the groove 11 is improved by anchoring ribs 17 which grap tightly the inner wall of the groove 11.

By the use of the fastener 9 there is further achieved that the fabric band 5 may, if necessary, be readily replaced. For this, the fastener 9, which is preferably made of synthetic material, is preferably designed with smooth groove walls, so that the edge portion 7 with the rib 6 may be easily pulled out.

The described folding partition may be provided on the top end with rollers in a manner not shown, the rollers being guided in a rail fastened at to a ceiling. When the partition is not in use, the sections 1,2,3 can be pushed together closely and require only a small space. In the closed position of the partition sections, see FIG. 2, the sections are slightly slanted relative to one another, so that it is easier to push the sections together.

In a simplified embodiment, the fastener 9 can be omitted and the groove 8 with the recess 10 provided directly in the hinged side faces of the sections.

I claim:

1. A folding partition of the type having a plurality of panel sections and hinge means for interconnecting adjacent edges of the sections wherein the hinge means comprises means defining grooves along the adjacent panel section edges for receiving fasteners;

a plurality of elongated fasteners for firm, positive insertion and attachment in said grooves, each said fastener including a generally U-shaped body portion insertable into a groove, said body portion having longitudinally extending anchoring ribs on the exterior surface thereof for frictional engagement in the groove, an interior slot, said slot terminating at its inner end in an enlarged cavity, and flange means laterally extending from said body portion for completely covering the faces of the panel edge adjacent the groove therein;

an elongated hinge member comprising a woven fabric band having longitudinally extending holding ribs along opposite edges thereof, said holding ribs being dimensioned to be received in said cavities in fasteners inserted into grooves in adjacent panel edges; and profiling strips for covering a portion of the band between said edges including a concave strip and a mating convex strip with said middle portion of said band being adhered to and held between said strips.

* * * * *